US006626068B2

(12) United States Patent
McKivigan

(10) Patent No.: US 6,626,068 B2
(45) Date of Patent: Sep. 30, 2003

(54) TOOL FOR INSTALLING A LAG HOOK AND METHOD FOR CABLING A TREE

(76) Inventor: Timothy McKivigan, 7210 Franklin Rd., Cranberry Township, PA (US) 16066

( * ) Notice: Subject to any disclaimer, the term of this patent is extended or adjusted under 35 U.S.C. 154(b) by 0 days.

(21) Appl. No.: 10/058,358

(22) Filed: Jan. 28, 2002

(65) Prior Publication Data

US 2003/0140739 A1 Jul. 31, 2003

(51) Int. Cl.[7] ..... B25B 13/00
(52) U.S. Cl. ..... 81/124.2; 81/901
(58) Field of Search ..... 81/119, 121.1, 81/124.2, 901

(56) References Cited

U.S. PATENT DOCUMENTS

| | | | | | |
|---|---|---|---|---|---|
| 292,880 | A | | 3/1884 | Lorillard, Jr. | |
| 562,041 | A | | 6/1896 | Seymour | |
| 693,406 | A | | 2/1902 | Kydd | |
| 841,472 | A | | 1/1907 | Vanderherchen | |
| 1,611,154 | A | | 2/1926 | Bertrand | |
| D160,267 | S | * | 9/1950 | McCammon et al. | 81/124.2 |
| 3,228,269 | A | * | 1/1966 | Heyer | 81/124.2 |
| 4,155,162 | A | * | 5/1979 | Weissman | 81/436 |
| 4,357,845 | A | | 11/1982 | Cornia | |
| 4,724,731 | A | | 2/1988 | Onofrio | |
| 4,984,489 | A | | 1/1991 | Krauthamer | |
| D319,171 | S | | 8/1991 | McCord, Jr. | |
| D320,148 | S | | 9/1991 | Andrews | |
| D320,542 | S | | 10/1991 | McCord, Jr. | |
| D329,795 | S | | 9/1992 | Bird et al. | |
| 5,335,569 | A | | 8/1994 | Rowley | |
| 5,791,208 | A | | 8/1998 | Grubbs | |
| 5,943,922 | A | | 8/1999 | Rolfe | |
| 6,230,592 | B1 | * | 5/2001 | Hsiao | 81/901 |
| 6,360,634 | B1 | * | 3/2002 | Leitch | 81/124.2 |

* cited by examiner

*Primary Examiner*—James G. Smith
(74) *Attorney, Agent, or Firm*—Clifford A. Poff

(57) ABSTRACT

A tool for applying torque to the hook formation of a lag hook for cabling a tree. The tool comprises an elongated body defining a rotational axis extending along the elongated length thereof between a torque receiving end and an opposite terminal end. An upper portion of the elongated body contains upper and lower wall surfaces forming two passageways at opposite sides of the rotational axis for passage of the curved end portion of a lag hook having either left-hand or right-hand threads to a socket traversed by the rotational axis and bounded by a torque delivering wall spaced from the rotational axis. A shank guide throat for the threaded shank of the lag hook extends from the socket between the lower wall surface and the terminal end of the elongated body.

14 Claims, 5 Drawing Sheets

TOOL FOR INSTALLING A LAG HOOK AND METHOD FOR CABLING A TREE

CROSS-REFERENCE TO RELATED APPLICATIONS none

BACKGROUND OF THE INVENTION

1. Field of the Invention

The present invention relates to a tool for threading a lag hook, also known as a j-hook or aj-lag, into the wood of a tree. Still, more particularly, this invention relates such a tool to drive such a lag hook for arboricultural purposes.

2. Description of the Prior Art

In the practice of arboriculture, preventive maintenance and repair measures for woody plants, in particular trees, involve the use of cabling. Threaded fasteners are used to form anchor sites for the installation of a flexible cable between a tree trunk and a tree branch or between tree branches of a tree. Cabling installed between branches functions to limit excessive branch motion and to reduce stress on a crotch formed by the branches and to reduce stress on the branches. The cabling may extend from a tree or a branch thereof to an adjacent tree or to the ground to provide needed support for the branch or trunk of the tree. More commonly, however, the arboriculture procedures will involve connecting two dominant branches of a forked tree so that each of the two dominant branches will support the other branch. Particularly, in the case of forked trees, cabling can effectively prevent or reduce splitting due to wind, ice, or the weight of a dominant branch or fruit produced by these branches.

One fastener commonly used in the cabling of trees is a lag hook. The lag hook has an elongated threaded shank driven into the wood of the tree after drilling a suitable pilot hole. The usual practice of providing a pilot hole involves selecting a drill bit with a diameter about ⅛ inch less than the pitch diameter of the threads on the shank of the lag hook to minimize stress and strain in both the lag hook and the wood of the tree. The threaded shank of the lag hook terminates at a short linear shank having a smooth and slightly larger diameter than the outside diameter of the threads on the shank. Usually, at least part of the short linear shank is advanced into the wood of the tree to gain the benefit of the added strength of the short shank and to seal the entrance to the threads of the threaded shank. The short shank terminates at a reversely curved hook shaped end portion. A considerable mechanical effort is needed to install the lag hook. A lag spinner is a commercially available hand tool used to apply torque to the hook-shaped end of the lag. A wrench or a screwdriver is other known hand tools also used to install a lag hook. Each of the lag spinner, wrench and screwdriver are used as a first class lever by engaging one end of the tool with the reversely curved, hook-shaped end of the lag hook and the free end of the lever receiving the applied torque. The lag hook is unstable under these conditions during the initial threading and at least until the threaded shank is firmly engaged with the wood surrounding the drilled pilot hole. These hand tools are often difficult to manipulate while maintaining the required coaxial relation between the longitudinal axis of the pilot hole and the rotational axis of the lag hook, particularly over the extended period of time needed to install the lag hook. The difficulty is increased because the installer may be suspended in a safety harness attached to one or more safety ropes.

It is an object of the present invention to provide a tool for stabilizing a lag hook during installation in the wood of a tree for arboriculture purposes.

It is another object of the present invention to provide a tool embodying a construction for efficiently transferring torque to the reversely curved hook-shaped end of the lag hook to facilitate driving the lag hook into a trunk or branch of a tree for cabling procedures.

SUMMARY OF THE INVENTION

According to the present invention, there is provided a tool for applying torque to the hook formation of a lag hook, the tool comprising an elongated body defining a rotational axis extending along the elongated length thereof between a torque receiving end and an opposite terminal end, an upper portion of the elongated body having upper and lower wall surfaces extending transversely in a spaced apart relation to form a passageway for a curved end portion of a lag hook to a socket traversed by the rotational axis and bounded by a torque delivering wall spaced from the rotational axis, and a shank guide throat extending from the socket by U-shaped surfaces spaced from the rotational axis and extending parallel to the elongated length of the elongated body section between the lower wall surface and the terminal end of the elongated body.

A preferred embodiment of the present invention provides that the upper portion of the elongated body traversed by the spaced apart upper and lower wall surfaces form two passageways at opposite sides of the rotational axis for passage of a curved end portion of a lag hook having left-hand or right-hand threads to the socket traversed by the rotational axis and bounded by a torque delivering wall spaced from the rotational axis.

The present invention further provides a method for cabling a tree including the steps of providing a tool comprising an elongated body defining a rotational axis extending along the elongated length thereof between a torque receiving end and an opposite terminal end, an upper portion of the elongated body having upper and lower wall surfaces extending transversely in a spaced apart relation to form a passageway for a curved end portion of a lag hook to a socket traversed by the rotational axis and bounded by a torque delivering wall spaced from the rotational axis, and a shank guide throat extending from the socket by U-shaped surfaces spaced from the rotational axis and extending parallel to the elongated length of the elongated body between the lower wall surface and the terminal end of the elongated body, passing a reversely curved hook shaped end of a lag hook through the space between the upper and lower surfaces and into contact with the torque delivering wall, positioning a threaded shank of the lag hook along the shank guide throat to align the longitudinal axis of the shank with the rotational axis of the elongated body, positioning the terminal end of the threaded shank against the wood of a tree at a selected site for cabling, rotating the tool about the rotational axis to mount the lag hook on the tree, removing the tool from both the shank and the reversely curved hook-shaped end of the lag hook, affixing one end of a cable to the reversely curved hook-shaped end of the lag hook and affixing the other end of the cable to a remote anchor.

BRIEF DESCRIPTION OF THE DRAWINGS

These features and advantages will be better understood when read in light of the accompanying drawings in which.

DESCRIPTION OF THE PREFERRED EMBODIMENTS

Figure 1:
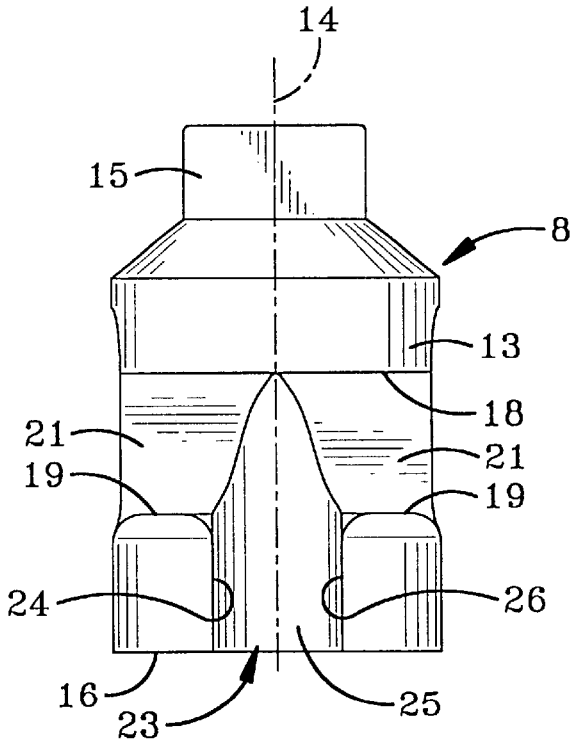
FIG. 1 is a front elevational view of a preferred embodiment of the tool of the present invention.

In FIGS. 1–7, there is illustrated the preferred embodiment of a tool 8 for applying torque to the curved, hook shaped end 9 to rotate a threaded shank 10 of a lag hook 11. A short linear shank 12 having a smooth and slightly larger diameter than the diameter of the threaded shank 10 is located between the curved, hook shaped end 9 and the threaded shank 10. The tool 8 includes a generally cylindrical, elongated body 13 defining a rotational axis 14 extending centrally along the elongated length of the body 13 between a torque receiving end 15 and an opposite terminal end 16. The torque receiving end includes a socket 17 having an internal cavity bounded by planar, torque receiving surfaces 17A for engagement with a square-shaped torque output shaft of a drive tool, not shown. The number of planar torque receiving surfaces 17A in the torque receiving end 15 could be, if desired, increased to form a hexagon configuration in which event the drive tool will be chosen with a correspondingly shaped hexagon shaped torque output shaft. The torque receiving end 15 could be, if desired, hex-shaped on the outside for driving the tool with a wrench. The drive tool may include a reversible ratchet mechanism for applying torque in either of opposite directions to the square shaped torque output shaft which typically measures ⅜ or ½ inch across the flat surfaces of the output shaft. The upper portion of the cylindrical, elongated body 13 is constructed with Bupper and lower wall surfaces 18 and 19, each extending transversely of the cylindrical, elongated body 13 in a spaced apart relation to form a passageway for the curved hook shaped end 9 of the lag hook 11.

Figure 2:
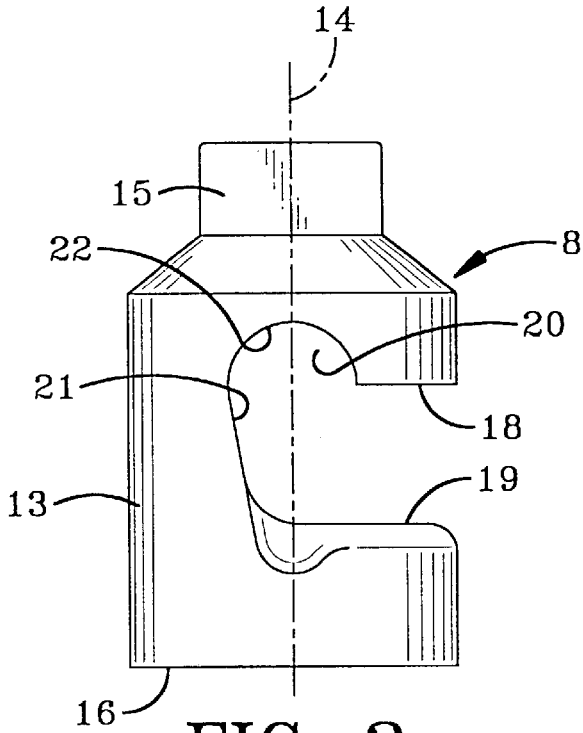
FIG. 2 is a left side view of the tool shown in FIG. 1.
Figure 3:
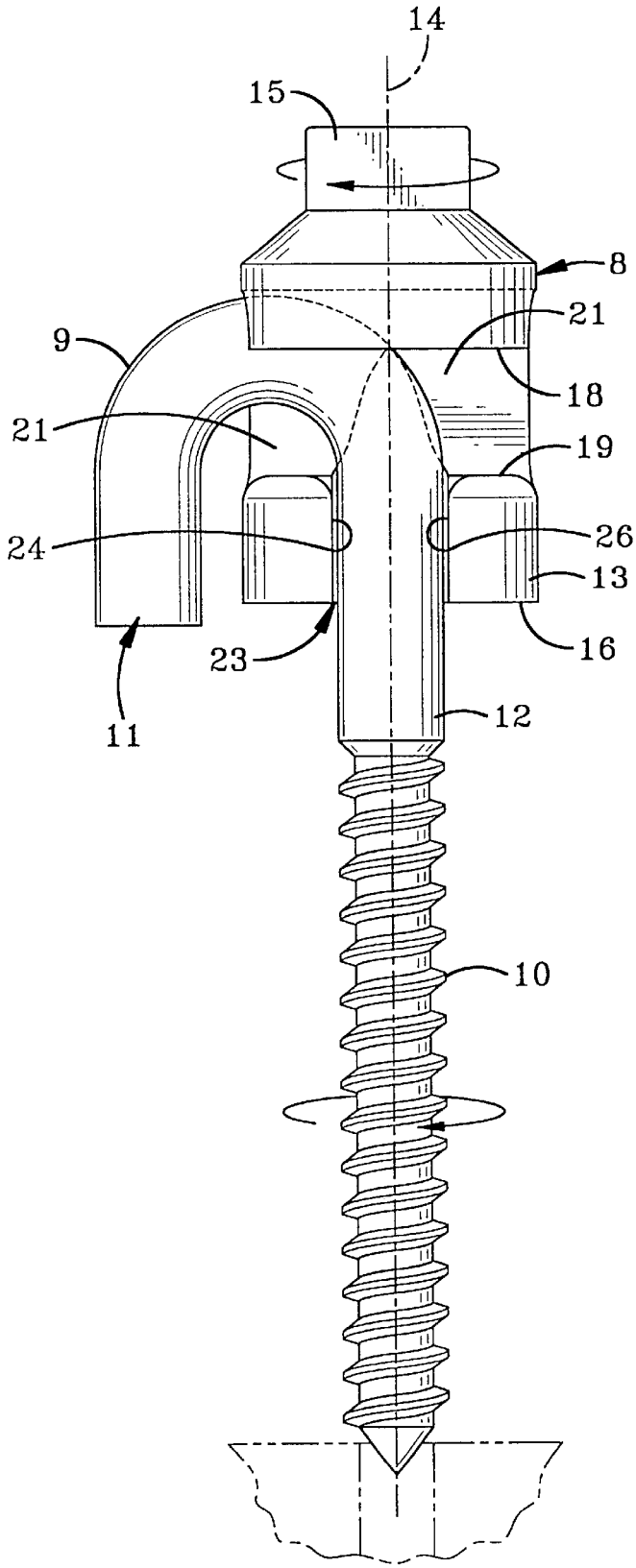
FIG. 3 is a front elevational view of the tool shown in FIG. 1 and lag hook.
Figure 4:
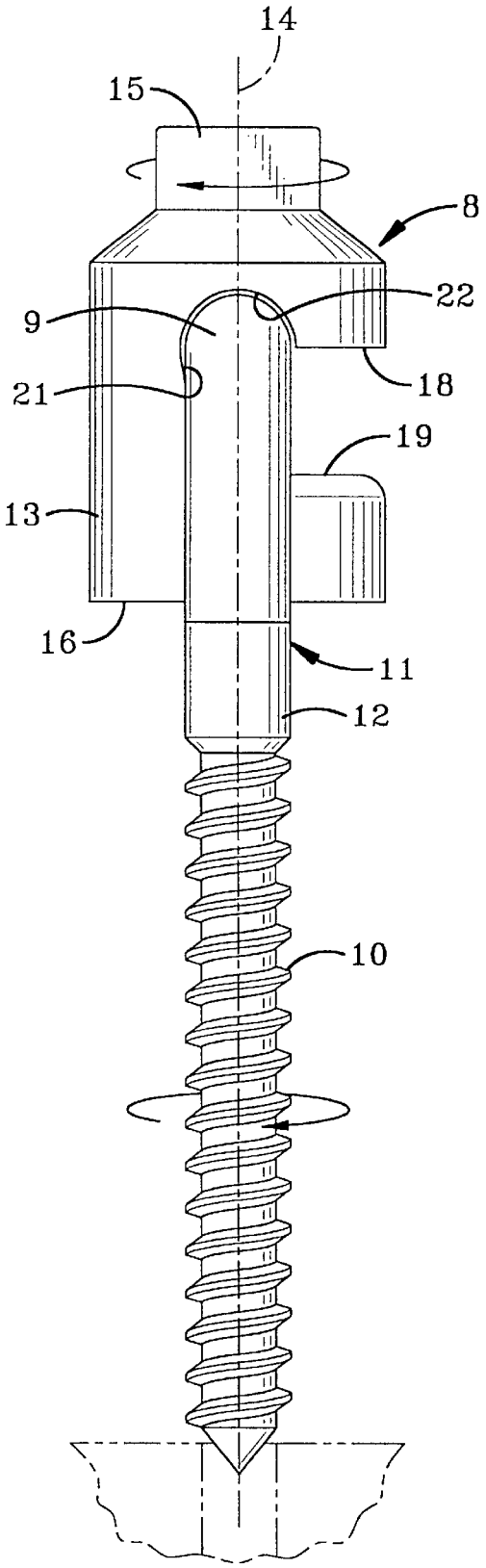
FIG. 4 is a left side view of the tool and lag hook shown in FIG. 3.
Figure 5:
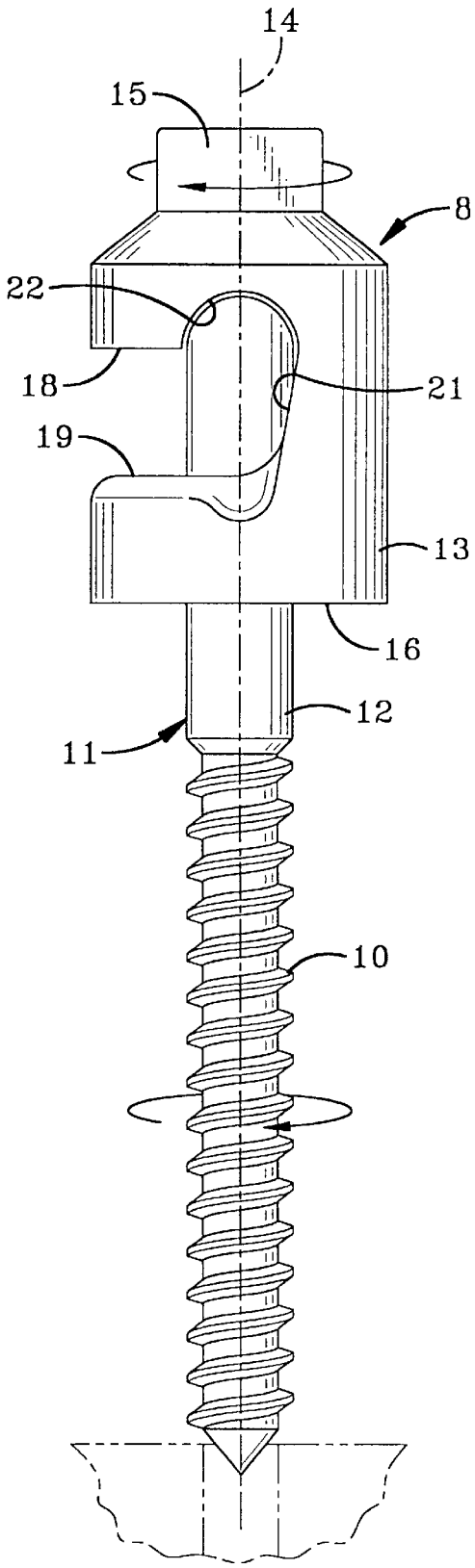
FIG. 5 is a right side view of the tool and lag hook shown in FIG. 3.
Figure 6:
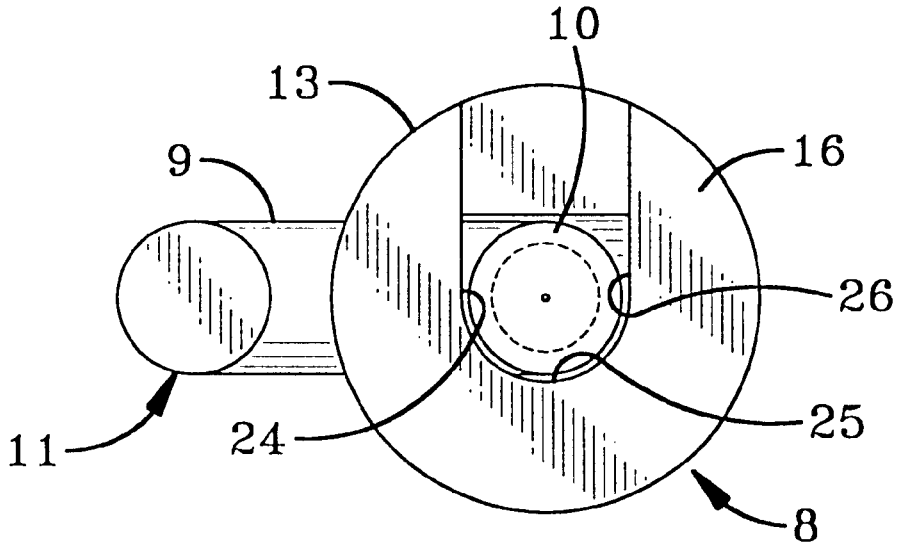
FIG. 6 is a bottom plan view of the tool and lag hook shown in FIG. 3.
Figure 7:
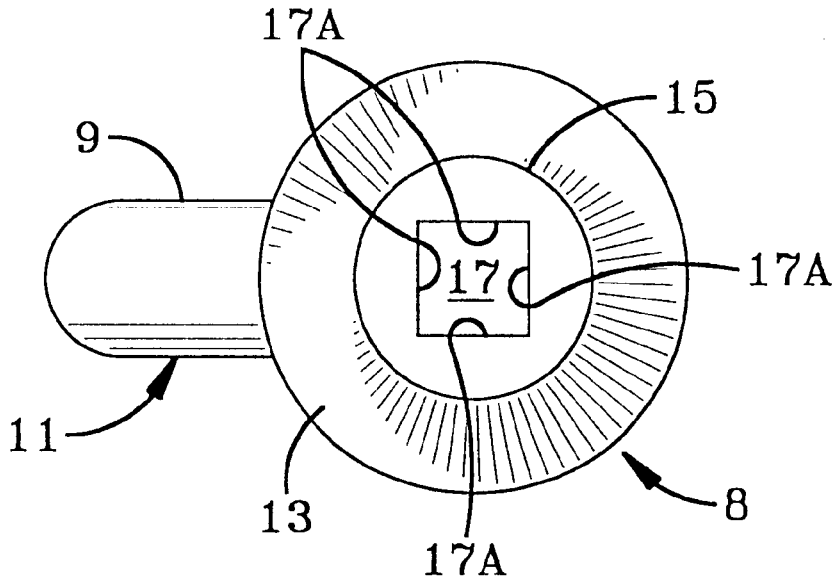
FIG. 7 is a top plan view of the tool and lag hook shown in FIG. 3.

The upper and lower wall surfaces 18 and 19 extend to a socket 20, identified in FIG. 2, traversed by the rotational axis 14 and bounded by a generally planar torque delivering wall 21 spaced from the rotational axis 14 by a distance corresponding to at least ½ the diameter of the short linear shank 12. The socket 20 has a "T" shaped configuration to provide two inverted "L" shaped passageways sharing a common passageway centered on the rotational axis 14 with the perpendicular legs of the "L" shaped passageways extending in opposite directions for receiving the curved hook shaped ends of lag hooks having either of left-hand or right-hand threads. The torque delivering wall 21 and the upper wall surface 18 are joined by an annular wall surface 22 traversing socket 20 and having a radius of curvature generally corresponding to a cross sectional radius of the curved hook-shaped end of a lag hook for at least a substantially seating engagement there between. The lower wall surface 19 has a generally annular peripheral configuration as best seen in FIGS. 1 and 3, at a distance corresponding to the cross-sectional diameter of the curved hook shaped end 11 extending from the generally planar torque delivering wall 21 for accommodating the annular cross sectional configuration of the internal area of the reversely curved end portion of a lag hook during passage into and from the socket 20. The lower portion of the cylindrical, elongated body 13 is constructed with a shank guide throat 23 extended from the socket 20 by a U-shaped arrangement of surfaces 24, 25 and 26 spaced from the rotational axis 14 and extending parallel to the elongated length of the elongated body 13 between the lower wall surface 19 and the terminal end 16. The annular wall surface 22 and the U-shaped arrangement of surfaces 24, 25 and 26 serve the important function of stabilizing the lag hook throughout the installation process in the wood of a tree, and these surfaces serve the additional function of maintaining the lag hook in a proper position for applying torque to the lag hook without risk to a loss of torque transmitting capabilities since the lag hook always remains in a positive metal to metal engagement with the tool 8.

Figure 8:
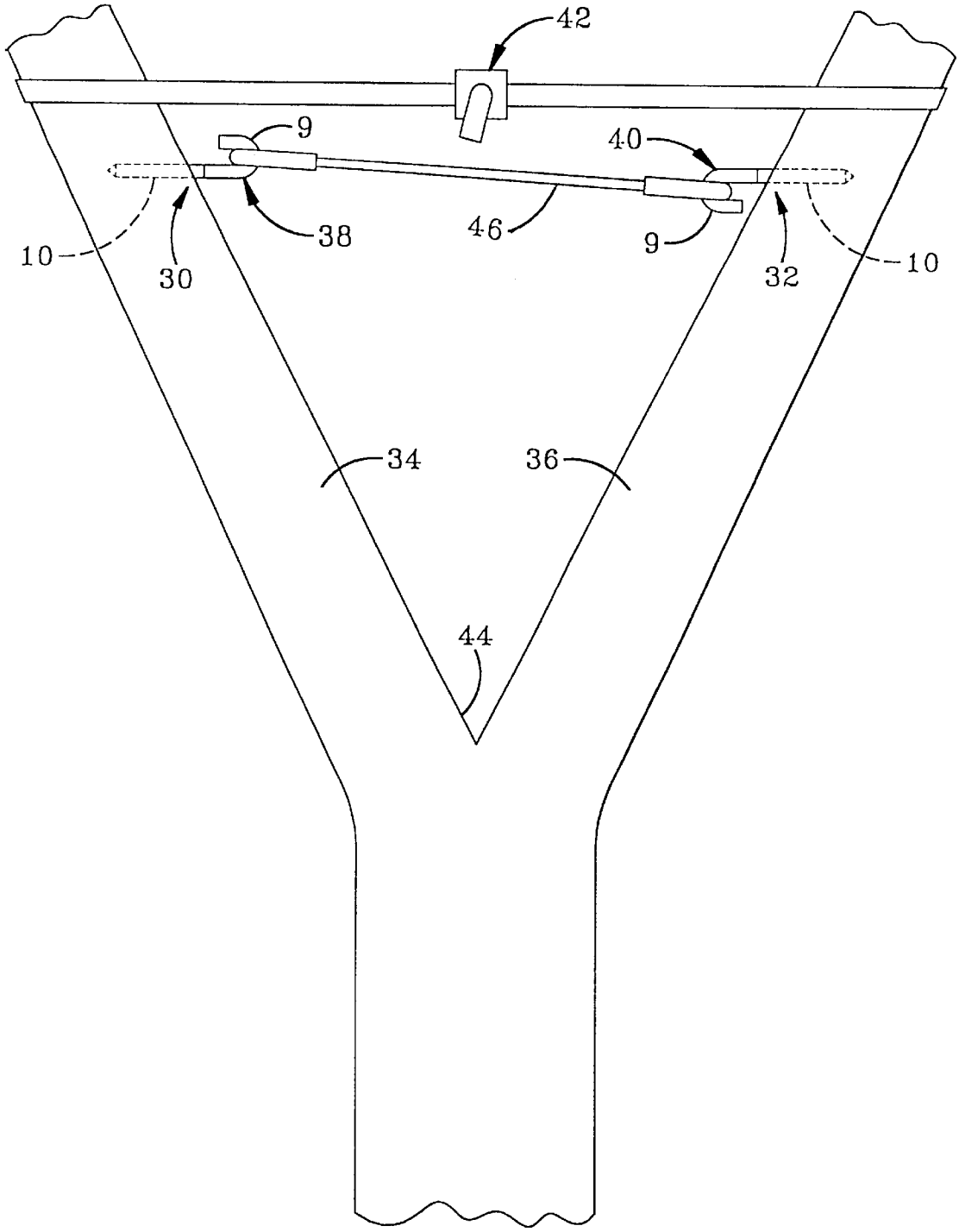
FIG. 8 is a schematic illustration of cabling of a tree using the tool of the present invention to install the lag hooks.

FIG. 8 is an example of the tool according to the present invention for cabling a tree by initially selecting, for example, two sites 30 and 32 in branches 34 and 36, respectively, for the installation of lag hooks 38 and 40, one lag hook having a left-hand thread shank and the other lag hook having a right hand threaded shank. Alternatively, dependent on the selected sites, the lag hooks may have threaded shanks with threads in the same direction. A pilot hole is formed in the wood of a tree using a drill bit having a diameter typically about ⅛ inch less than the pitch diameter of the threaded shanks of the selected lag hooks 38 and 40. The tool 8 embodying the features of the present invention is connected to the drive output shaft of a ratchet or other suitable drive device for rotating the tool in a direction to advance the threaded shank of the lag hook 38, after the latter is mounted in the tool, into the wood of the tree using the pilot hole to facilitate the installation. The lag hook 38 is installed in the tool by passing the reversely curved hook-shaped end of a lag hook through the space between the upper and lower surfaces 18 and 19 and into contact with the torque delivering wall 21. The shank of the lag hook is passed along the shank guide throat 23 into an aligned relation between the longitudinal axis of the shank 11 and the rotational axis 14 and then the curved hook shaped end 9 is seated against the annular wall surface 22. After positioning the terminal end of the threaded shank against the wood of the tree at the site selected for cabling, the tool is rotated about the rotational axis 14 to thread the lag hook to the tree. The tool is then removed from the lag hook 38 and the second lag hook 40 is installed at its selected site in the same manner as the first lag hook A come-along 42 or other suitable tensioning device is installed between the tree branches 34 and 36 usually above the lag hooks 38 and 40 and operated to draw the tree branches toward one another sufficiently to relieve stress and strain on the crotch 44. Thereafter, termination hardware is installed to form a termination to the ends of a cable 46 engaged with the lag hooks 38 and 40. The termination hardware includes but is not limited to dead-end grips, thimbles used in eye-splice configurations, and swages. One of the lag hooks may comprise a remote earthen anchor or a lag hook installed on an adjacent tree.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

I claim:

1. A tool for applying torque to the hook formation of a lag hook, said tool comprising an elongated body defining a rotational axis extending along the elongated length thereof between a torque receiving end and an opposite terminal end, an upper portion of said elongated body having upper and lower wall surfaces extending transversely in a spaced apart relation to form a passageway terminating at a generally planer torque delivering wall for engaging with a curved end portion of a lag hook in a socket traversed by said rotational axis and bounded by said generally planer torque delivering wall within said socket at a spaced relation from said rotational axis, and a shank guide throat extending from said socket by U-shaped surfaces spaced from said rotational axis and extending parallel to the elongated length of said elongated body section between said lower wall surface and said terminal end.

2. The tool according to claim 1 wherein said torque receiving end includes planar torque receiving surfaces for engagement with a drive tool.

3. The tool according to claim 1 wherein said body is generally cylindrical.

4. The tool according to claim 1 wherein said torque delivering wall is planar between the spaced apart upper and lower wall surfaces.

5. The tool according to claim 1 wherein said torque delivering wall and said upper wall surface are joined by an annular wall surface having a radius of curvature for supporting the curved end portion of a lag hook.

6. The tool according to claim 1 wherein said lower wall surface includes a generally annular cross sectional configuration for accommodating the internal reversely curved end portion of a lag hook passing into and from said socket.

7. A tool for applying torque to the hook formation of a lag hook, said tool comprising an elongated body defining a rotational axis extending along the elongated length thereof between a torque receiving end and an opposite terminal end, an upper portion of said elongated body being traversed by spaced apart upper and lower wall surfaces forming two passageways at opposite sides of said rotational axis for passage of a curved end portion of a lag hook having left or right hand threads into a socket traversed by said rotational axis and bounded by a torque delivering wall spaced from said rotational axis, and a shank guide throat for the shank of a lag hook extending from said socket, said shank guide throat having U-shaped surfaces spaced from said rotational axis and extending parallel to the elongated length of said elongated body section between said lower wall surface and said terminal end.

8. The tool according to claim 7 wherein said torque receiving end includes planar torque receiving surfaces for engagement with a drive tool.

9. The tool according to claim 7 wherein said body is generally cylindrical.

10. The tool according to claim 7 wherein said torque delivering wall is planar.

11. The tool according to claim 7 wherein said torque delivering wall and said upper wall surface are joined by an annular wall surface having a radius of curvature for supporting the curved end portion of a lag hook.

12. The tool according to claim 7 wherein said lower wall surface includes a generally annular cross sectional configuration for accommodating the internal reversely curved end portion of a lag hook passing into and from said socket.

13. A method for cabling a tree, said method including the steps of:

providing a tool comprising an elongated body defining a rotational axis extending along the elongated length thereof between a torque receiving end and an opposite terminal end, an upper portion of said elongated body having upper and lower wall surfaces extending transversely in a spaced apart relation to form a passageway for a curved end portion of a lag hook to a socket traversed by said rotational axis and bounded by a torque delivering wall spaced from said rotational axis, and a shank guide throat extending from said socket by u-shaped surfaces spaced from said rotational axis and extending parallel to the elongated length of said elongated body section between said lower wall surface and said terminal end;

passing a reversely curved hook-shaped end of a lag hook through the space between said upper and lower surfaces and into contact with said torque delivering wall and positioning the shank of the lag hook along said shank guide throat to align the longitudinal axis of the shank with said rotational axis;

forming a pilot hole at site selected for cabling of said lag hook;

positioning the shank terminal end against the wood of a tree at said selected site for cabling and rotating the tool about said rotational axis to mount the lag hook on the tree;

removing the tool from the shank and the reversely curved hook shaped end of the lag hook; and affixing one of end of a cable to the reversely curved hook-shaped end of said lag hook and the other of end of said cable to a remote anchor.

14. The method according to claim 13 wherein said step of providing a tool includes providing a tool having an upper portion of said elongated body traversed by said spaced apart upper and lower wall surfaces forming two passageways at opposite sides of said rotational axis for passage of a curved end portion of a lag hook having either left-hand or right-hand threads to said socket traversed by said rotational axis and bounded by said torque delivering wall surface spaced from said rotational axis; and wherein said step of selecting a lag hook includes-selecting two lag hooks, one having right-hand threads on the shank thereof and the other lag hook having left-hand threads on the shank thereof; the method including the further steps of using the tool to install each of the lag hooks having left-hand and right-hand threads on the tree; and said step of affixing consists of securing the ends of the cable to the reversely curved hook shaped end of said lag hooks having left-hand and right-hand threads.

* * * * *